US010933303B2

(12) United States Patent
Jackson

(10) Patent No.: US 10,933,303 B2
(45) Date of Patent: Mar. 2, 2021

(54) INSTANT GAME TICKET WITH SECTIONED SYMBOLS

(71) Applicant: Kathleen Nylund Jackson, Newport, NC (US)

(72) Inventor: Kathleen Nylund Jackson, Newport, NC (US)

( * ) Notice: Subject to any disclaimer, the term of this patent is extended or adjusted under 35 U.S.C. 154(b) by 0 days.

(21) Appl. No.: 16/680,802

(22) Filed: Nov. 12, 2019

(65) Prior Publication Data

US 2020/0078663 A1 Mar. 12, 2020

(51) Int. Cl.
*A63F 3/06* (2006.01)

(52) U.S. Cl.
CPC ..... *A63F 3/0665* (2013.01); *A63F 3/06* (2013.01); *A63F 3/062* (2013.01); *A63F 3/0605* (2013.01); *A63F 2003/067* (2013.01); *A63F 2003/0675* (2013.01)

(58) Field of Classification Search
CPC ..... A63F 3/06; A63F 3/0605; A63F 3/0665; A63F 3/062; A63F 2003/067; A63F 2003/0675
USPC ..... 273/139; 283/901, 903
See application file for complete search history.

(56) References Cited

U.S. PATENT DOCUMENTS 5,002,313 A 3/1991 Salvatore
5,046,737 A 9/1991 Feinberg
5,074,566 A 12/1991 Desbiens
5,092,598 A 3/1992 Kamille
5,118,100 A 6/1992 Gremina
5,158,293 A 10/1992 Mullins
5,193,815 A 3/1993 Pollard
5,407,200 A 4/1995 Zalabak
5,494,317 A 2/1996 Johnson
5,657,991 A 8/1997 Camarato
5,743,524 A 4/1998 Nannicola
5,909,875 A 6/1999 Weingardt
5,934,671 A 8/1999 Harrison
6,241,246 B1 6/2001 Guttin et al.
6,250,685 B1 6/2001 Walker et al.
6,588,747 B1 7/2003 Seelig
6,612,576 B1 9/2003 Stancik et al.
6,698,755 B2 3/2004 Cherry
6,761,633 B2 7/2004 Riendeau et al.
6,889,978 B2 5/2005 Schaefer et al.
6,918,589 B2 7/2005 Thibault
6,926,273 B1 8/2005 Vancura
7,004,506 B2 2/2006 Downes et al.
7,396,015 B2 7/2008 Feola
7,410,168 B2 8/2008 Gumina
7,429,044 B2 9/2008 O'Brien
7,481,432 B2 1/2009 Feola
7,497,778 B2 3/2009 Bozeman
(Continued)

*Primary Examiner* — Benjamin Layno

(57) ABSTRACT

A method of playing a lottery instant scratch ticket game comprises a plurality of scratch tickets, wherein game symbols are provided for each ticket. Each game symbol is divided into symbol sections and each symbol section is numbered and covered with a removable film. Player numbers are covered with an opaque removable film. The opaque film is removed to reveal the player symbols. The film over any numbered symbol section that matches a player symbol is removed to reveal the said symbol section. In various embodiments, a) a single symbol that is fully revealed may win a prize, (b) two or more symbols that are fully revealed may win a prize or c) two or more symbols that are fully revealed may win a prize larger than the prize of a single symbol.

24 Claims, 10 Drawing Sheets

(56) References Cited

U.S. PATENT DOCUMENTS

| | | | | |
|---|---|---|---|---|
| 7,510,116 | B2 | 3/2009 | Robb et al. | |
| 7,530,570 | B2 | 5/2009 | Nulph et al. | |
| 7,959,188 | B2 | 6/2011 | Martineck | |
| 7,980,559 | B2 | 7/2011 | Miller et al. | |
| 8,231,449 | B2 | 7/2012 | Martineck, Sr. | |
| 8,262,461 | B2 | 9/2012 | Frick | |
| 8,298,063 | B2 | 10/2012 | Packes et al. | |
| 8,333,380 | B2 | 12/2012 | Berkowitz | |
| 8,512,123 | B2 | 8/2013 | Stanek et al. | |
| 8,523,078 | B2 | 9/2013 | Biskupski | |
| 8,579,693 | B2 | 11/2013 | Bennett, III et al. | |
| 8,628,082 | B2 | 1/2014 | Martineck | |
| 8,672,325 | B2 | 3/2014 | Green | |
| 8,864,565 | B2 | 10/2014 | Packes et al. | |
| 2002/0130464 | A1 | 9/2002 | Taylor et al. | |
| 2005/0148379 | A1 | 7/2005 | Huard et al. | |
| 2006/0252488 | A1 | 11/2006 | LaLonde et al. | |
| 2006/0287055 | A1 | 12/2006 | Hamud | |
| 2007/0021186 | A1 | 1/2007 | Hamud | |
| 2007/0187888 | A1 | 8/2007 | Dures et al. | |
| 2009/0098922 | A1 | 4/2009 | Cummings et al. | |
| 2009/0253481 | A1 | 10/2009 | Honour | |
| 2010/0144417 | A1 | 6/2010 | Wright et al. | |
| 2011/0281637 | A1 | 11/2011 | Meyer et al. | |
| 2012/0289302 | A1 | 11/2012 | Martinez | |
| 2013/0324212 | A1 | 12/2013 | Frick et al. | |
| 2014/0246849 | A1 | 9/2014 | Frost | |
| 2014/0274275 | A1 | 9/2014 | DeFrance et al. | |
| 2014/0375045 | A1* | 12/2014 | Jackson | A63F 3/0605 283/67 |
| 2015/0115593 | A1* | 4/2015 | Jackson | B41M 3/005 283/67 |

* cited by examiner

INSTANT GAME TICKET WITH SECTIONED SYMBOLS

BACKGROUND OF THE INVENTION

1. Field of the Invention

The present invention relates to an instant game ticket (otherwise known in the art as a "scratch ticket"). The invention further relates to lottery gaming wherein the physical instant game ticket may be purchased and verified at a lottery agent location or other suitable locations, the ticket utilizing symbol sections that when fully revealing a symbol, may provide a prize. An electronic version is also discussed.

2. Background of the Art

For nearly 50 years, instant game tickets, or scratch tickets as in known in the art, have been offered for sale as part of city, state, and national lotteries. These tickets typically have an array of winning numbers and an array of player numbers, each concealed with a removable film. The player scratches off the film to reveal the numbers. If a player number matches a winning number, a prize is won.

Scratch ticket games are provided wherein a predetermined number of tickets are printed, each ticket providing either a losing result or a winning result. The amount of tickets with losing results is predetermined, as are the number of tickets with winning results. Also predetermined is the number of tickets for each individual win amount. The total amount of awards of the winning tickets will be less than the total cost of all tickets in the game. For instance, a total of 90,720,000 $5 tickets may be printed and sold. The total ticket sales will be $453,600,000. The total payout to players may be $345,471,000.

Scratch tickets (otherwise known as instant tickets or scratchers) have gained considerable popularity since they provide a near instant gratification; that is, the result can be determined in mere seconds. Traditional scratch tickets provide winning numbers and player numbers, wherein a match between a winning number and a player number provides a prize.

In order to keep the gameplay fresh and appealing, new versions of the instant ticket have been created. Various attempts have been made to create new instant games and gameplay in order to increase player participation and excitement.

U.S. Pat. No. 8,628,082 (Martineck) teaches a lottery instant-game ticket and method of making same. On a substrate is placed a first set of game indicia including a first set of game symbols, and a second set of indicia larger than the first set of game indicia and including a second set of game symbols, and includes any winning symbol. A subset of the second set of game indicia with each symbol including a non-winning indicator. The first set and second of game indicia are covered with a removable covering, with the covering having position indicators positioned substantially over each of the first set of game indicia, and identical game symbols positioned substantially over a corresponding identical game symbol of the second set of game indicia such that removal of the identical game symbol reveals the identical game symbol of the second set of game indicia and any non-winning indicator, if present.

U.S. Pat. No. 7,481,432 (Feola) discloses a method of playing a poker-type scratch ticket game where a scratch ticket has a plurality of two-card, known, starter hands and five unrevealed community cards. A player reveals the community cards. Each starter hand is combined with the community cards to form complete hands. The player is paid a predetermined amount if any of the complete hands is found in a pay table. Optionally, the predetermined amount is based on the rank of the hand. Optionally, there is more than one set of community cards.

United States Patent Application No. 20140246849 (Frost) teaches a scratch off lottery ticket and method of manufacturing the scratch off lottery ticket in which the lottery ticket contains multiple game play areas where a player can scratch off a layer of scratch off material to reveal the hidden results, and depending on those results, can be awarded prizes for each particular game play area or can be awarded prizes for the combination of the results from two or more of the multiple game play areas.

United States Patent Application No. 20060252488 (LaLonde, et al.) provides a lottery type game for play on a game medium wherein the lottery type game comprises a primary game area having therein a plurality of target symbols and a secondary game area having a plurality game symbols therein. The game symbols are positioned in one or more arrangements within the secondary game area. During play of the game, target symbols are used to reveal game symbols within the one or more arrangements through actions including matching of target and game symbols. Prior to play of the lottery type game at least one of the primary game area or the secondary game area is concealed from the view of the player, wherein during play of the game some or all of the concealed symbols are revealed. Prize determining means are associated with the game medium, wherein a predetermined prize is associated with each arrangement of game symbols. A prize associated with a particular arrangement of game symbols is won when all of the game symbols associated with the particular arrangement are revealed during play of the game. The winning of a lottery type game according to the present invention may not be accomplished solely by matching target symbols with game symbols, an additional action or revealed game symbol can typically be required in order to reveal a complete arrangement of game symbols. This additional action or game symbol identification can provide a player with an additional incentive to play the game, since by just revealing the target symbols one is typically unable to determine if a prize is won.

Each of the references discussed in this text art are incorporated herein in their entirety for all purposes.

It is an ever-increasing challenge to provide players with new and enticing gameplay features that will stimulate player interest and increase participation in instant lottery games. Extended-play tickets have been introduced to the lottery market, appealing to players that prefer a longer play method. Unfortunately, some of these longer-playing tickets incorporate confusing or difficult gameplay. The present invention provides a simple, easy-to-understand play method while still providing excitement and increased anticipation.

SUMMARY OF THE INVENTION

The present invention discloses an instant lottery ticket and method of conducting a lottery instant scratch ticket game that provides a plurality of physical scratch tickets, wherein game symbols are provided for each ticket. Each game symbol is divided into a predetermined amount of symbol sections. Each symbol section is marked by a unique marking symbol from a predetermined set of marking symbols, and is covered with a removable film. An array of marking symbols from the set of marking symbols is provided as player symbols, and is covered with an opaque removable film. The opaque film is removed to reveal the player symbols. The film over any marked symbol section that matches a player symbol is removed to reveal the said symbol section. In various embodiments, a) a single symbol that is fully revealed may win a prize, (b) two or more symbols that are fully revealed may win a prize or c) two or more symbols that are fully revealed may win a prize larger than the prize of a single symbol.

DETAILED DESCRIPTION OF THE INVENTION

Figure 1A:
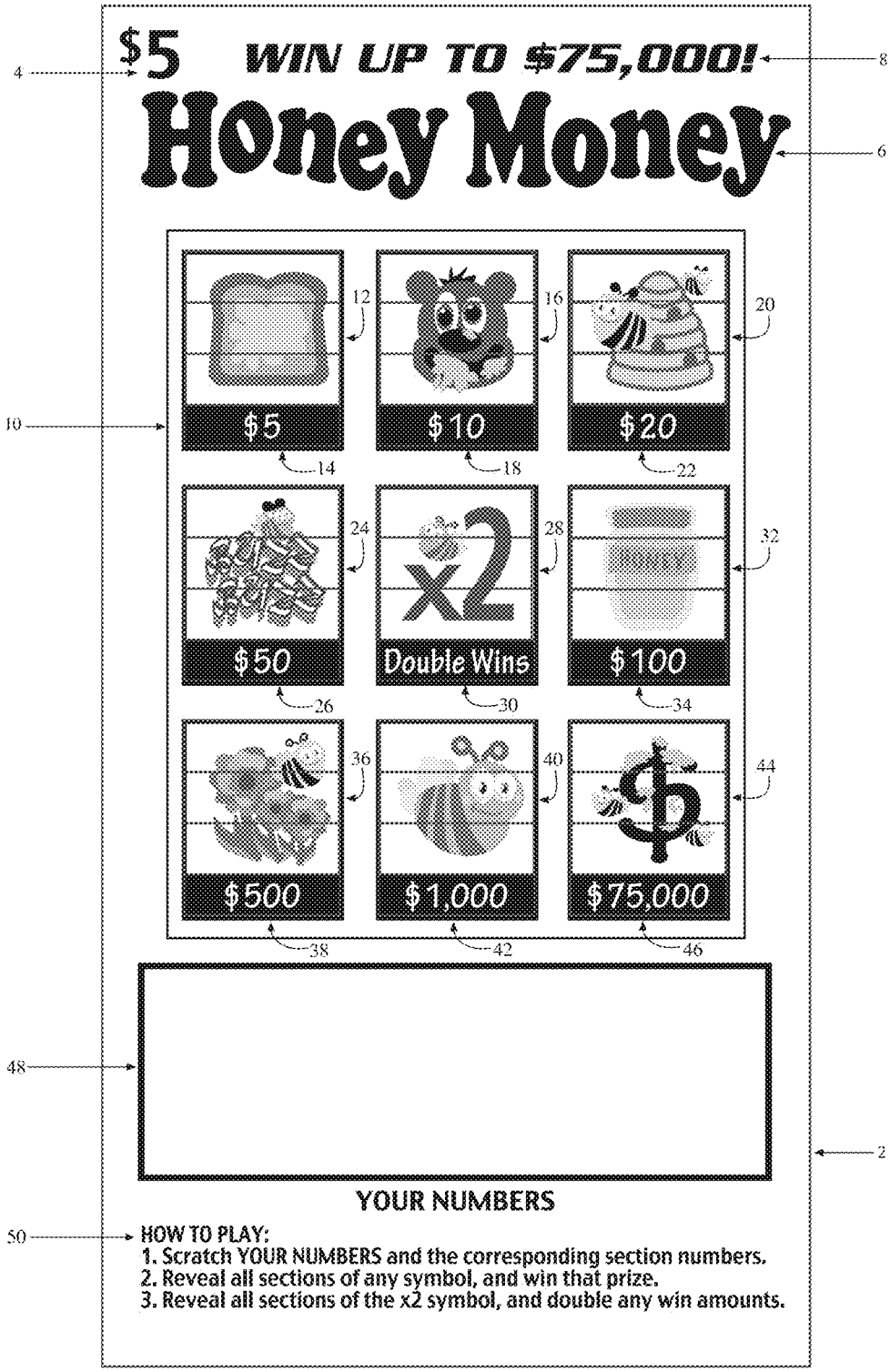
FIG. 1A shows the base card of an instant scratch ticket containing the game elements for a game utilizing the game technology described in a first preferred embodiment of the present invention herein.

A first preferred embodiment of the present invention describes an instant lottery ticket and method of conducting a lottery instant scratch ticket game that comprises: a) providing a plurality of physical scratch tickets; b) providing a predetermined set of unique play symbols; c) providing a game play grid on each ticket comprising a predetermined amount of play spaces; d) populating each play space with a play symbol from the predetermined set of unique play symbols; e) providing a different prize associated with each play symbol; f) dividing each play symbol into at least two play symbol sections; g) covering all of the play symbol sections with a removable film; h) providing a predetermined set of unique marking symbols; i) providing one unique marking symbol from the set of marking symbols for each play symbol section; j) providing an array of marking symbols on each ticket from the set of marking symbols as player symbols; k) concealing the player symbols with an opaque removable film; l) revealing each player symbol by removing the opaque removable film concealing the player symbols; m) removing the removable film comprising each marking symbol and its associated play symbol section that matches a player symbol to reveal the play symbol section; n) determining if all of the play symbols sections of at least one play symbol are fully revealed; and o) providing the prize associated with each fully revealed play symbol.

An exemplary first preferred embodiment of the present invention discloses a lottery game in which a plurality of instant scratch tickets is provided. A wager of cash, credits or non-monetary points may be required to play the game. The name of the game is shown on each ticket. Preferably, a printed verification code is provided and is concealed underneath an opaque film. The said verification code provides an encryption that guarantees that the ticket is valid and maintains the authenticity of the instant game ticket. The price of the ticket is provided, as well as instructions.

An array of game symbols from a predetermined set of game symbols is provided and each symbol is divided into at least two sections, but preferably three sections. Each game symbol is associated with a differing prize. Each symbol section is concealed by a removable film, preferably a transparent removable film. Each symbol section is marked with a unique marking symbol from a predetermined set of unique marking symbols. It is preferred that the marking symbols are numerals, and that the amount of numerals in the set of numerals equals the total amount of symbol sections. An array of unique numerals from the set of unique numerals is provided as player numbers, and is concealed by an opaque removable film.

The opaque removable film is scratched off to reveal the player numbers. Each numbered symbol section that matches a player number is removed to reveal the symbol section. If all symbol sections of a game symbol are revealed, the prize associated with that said symbol is awarded.

A second preferred embodiment of the present invention describes an instant lottery ticket and method of conducting a lottery instant scratch ticket game that comprises: a) providing a plurality of physical scratch tickets; b) providing a first predetermined set of unique play symbols; c) providing a second predetermined set of unique play symbols wherein all of the play symbols in the second set of play symbols differ from all of the symbols in the first set of play symbols; d) providing a first game play area on each ticket comprising an array of symbol areas wherein the amount of symbol areas equals the amount of play symbols in the first set of play symbols and wherein each symbol area comprises an equal amount of symbol spaces; e) providing a second game play area on each ticket comprising an array of symbol areas wherein the amount of symbol areas equals the amount of play symbols in the second set of play symbols and wherein each symbol area comprises an equal amount of symbol spaces; f) designating one symbol space in each symbol area as a target win space; g) providing different prizes for each target win space; h) populating all of the symbol spaces with one play symbol from the first set of play symbols and one play symbol from the second set of play symbols wherein all symbol spaces within any specific symbol area comprise either one specific play symbol from the first set of play symbols or one specific play symbol from the second set of play symbols; i) providing a boxed area on each ticket comprising one each of all of the play symbols in the first set of play symbols and one each of all of the play symbols in the first set of play symbols; j) dividing each play symbol in the boxed area into at least two play symbol sections; k) covering all of the play symbol sections in the boxed area with a removable film; l) providing a predetermined set of unique marking symbols; m) providing one unique marking symbol from the set of marking symbols for each symbol section; n) providing an array of marking symbols on each ticket from the set of marking symbols as player symbols; o) concealing the player symbols with an opaque removable film; p) revealing each player symbol by removing the opaque removable film concealing the player symbols; q) removing the removable film comprising each marking symbol and its associated symbol section that matches a player symbol to reveal a symbol section; r) determining if all of the symbols sections of at least one play symbol from the first set of play symbols and at least one play symbol from the second set of play symbols are fully revealed; s) determining if the fully revealed play symbols match both of the play symbols in any target win space; and t) providing any prizes associated with said target win space.

An exemplary second preferred embodiment of the present invention discloses a lottery game in which a plurality of instant scratch tickets is provided. A wager of cash, credits or non-monetary points may be required to play the game. The name of the game is shown on each ticket. Preferably, a printed verification code is provided and is concealed underneath an opaque film. The said verification code provides an encryption that guarantees that the ticket is valid and maintains the authenticity of the instant game ticket. The price of the ticket is provided, as well as instructions.

A first predetermined set of unique play symbols and a second predetermined set of unique play symbols are provided wherein all of the play symbols in the first set of play symbols differ from all of the symbols in the second set of play symbols. In this said exemplary second embodiment, the first set of play symbols comprises five playing card ranks, specifically 10, Jack, Queen, King and Ace (10, J, Q, K, A). The second set of play symbols comprises four playing card suits (Club, Diamond, Heart and Spade). A first game play area on each ticket is provided, comprising an array of symbol areas wherein the amount of symbol areas equals the amount of play symbols in the first set of play symbols and wherein each symbol area comprises an equal amount of symbol spaces. Specifically, five symbol areas are provided, each said symbol area comprising four symbol spaces as playing cards. Each symbol area represents a 4-of-a-Kind hand (4-of-a-Kind 10s, 4-of-a-Kind Js, 4-of-a-Kind Qs, 4-of-a-Kind Ks and 4-of-a-Kind As). The four symbol spaces comprising each 4-of-a-Kind hand comprise one said symbol space as a target win playing card. A second game play area on each ticket is provided, comprising an array of symbol areas wherein the amount of symbol areas equals the amount of play symbols in the second set of play symbols and wherein each symbol area comprises an equal amount of symbol spaces. Specifically, four symbol areas are provided, each said symbol area comprising five symbol spaces as playing cards. Each symbol area represents a Royal Flush hand (Royal Flush in Clubs, Royal Flush in Diamonds, Royal Flush in Hearts and Royal Flush in Spades). The five symbol spaces comprising each Royal Flush hand comprise one said symbol space as a target win playing card. Each of the nine total target wins playing cards in the 4-of-a-Kind and Royal Flush hands is associated with a differing prize.

All of the symbol spaces are populated with one play symbol from the first set of play symbols and one play symbol from the second set of play symbols representing a specific playing card. All symbol spaces within any specific symbol area comprise either one specific play symbol from the first set of play symbols or one specific play symbol from the second set of play symbols. If a specific symbol area comprises one specific play symbol from the first set of play symbols, each symbol space in the said symbol area also comprises a unique play symbol from the second set of play symbols. If a specific symbol area comprises one specific play symbol from the second set of play symbols, each symbol space in the said symbol area also comprises a unique play symbol from the first set of play symbols. For example, the 4-of-a-Kind 10s hand shows the 10 of Diamonds, the 10 of Clubs, the 10 of Hearts and the 10 of Spades; the Royal Flush hand in Spades shows the 10 of Spades, the J of Spades, the Q of Spades, the K of Spades and the A of Spades. It should be noted that the target win space is preferably the last playing card in each hand, and the order of the playing cards in each hand vary from ticket to ticket, so that the target win playing cards will not be the same on each ticket.

A boxed area on each ticket comprises one each of all of the play symbols in the first set of play symbols and one each of all of the play symbols in the first set of play symbols, so in continuing the example, the boxed area comprises the nine play symbols 10, J, Q, K, A, Club, Diamond, Heart and Spade. Each play symbol in the boxed area is divided into three symbol sections and each symbol section in the boxed area is covered with a transparent removable film. Each symbol section is marked with a unique marking symbol from a predetermined set of unique marking symbols. It is preferred that the marking symbols are numerals, and that the amount of numerals in the set of numerals equals the total amount of symbol sections. An array of unique numerals from the set of unique numerals is provided as player numbers, and is concealed by an opaque removable film.

The opaque removable film is scratched off to reveal the player numbers. Each numbered symbol section that matches a player number is removed to reveal the symbol section. If all symbol sections of a game symbol are fully revealed, that said symbol is considered a qualified symbol. Preferably, each ticket is designed to fully reveal one rank as a qualified symbol and one suit as a qualified symbol. The two qualified symbols represent a specific playing card, and if the said specific playing card matches a target win playing card, the prize associated with that target win card's hand is awarded. For example, if the Queen symbol and the Heart symbol are fully revealed, and the Queen of Hearts is the target win card in the Royal Flush in Hearts hand, the player would win the prize associated with the target win card in the Royal Flush in Hearts hand.

A third preferred embodiment of the present invention describes an instant lottery ticket and method of conducting a lottery instant scratch ticket game that comprises: a) providing a plurality of physical scratch tickets; b) providing a predetermined set of unique numerical play symbols representing dollar amounts; c) providing a game play grid on each ticket comprising a predetermined amount of horizontal rows; d) populating each row with a predetermined amount of play symbols wherein the play symbols in the left-hand position of each row are differing play symbols; e) designating the left-hand position of each row as the first position; f) dividing each play symbol in the game play grid into at least two play symbol sections; g) covering all of the play symbols in the game play grid with a removable film; h) providing a predetermined set of unique marking symbols; i) providing one unique marking symbol from the set of marking symbols for each play symbol section; j) providing an array of marking symbols on each ticket from the set of marking symbols as player symbols; k) concealing the player symbols with an opaque removable film; l) revealing each player symbol by removing the opaque removable film concealing the player symbols; m) removing the removable film comprising each marking symbol and its associated play symbol section that matches a player symbol to reveal the play symbol section; n) determining if all of the play symbols sections of at least one play symbol in the first position of a row are fully revealed; o) determining if any additional play symbols are fully revealed and contiguous with any fully revealed first position play symbols; and t) providing any dollar amount wins associated with the fully revealed play symbols.

An exemplary third preferred embodiment of the present invention discloses a lottery game in which a plurality of instant scratch tickets is provided. A wager of cash, credits or non-monetary points may be required to play the game. The name of the game is shown on each ticket. Preferably, a printed verification code is provided and is concealed underneath an opaque film. The said verification code provides an encryption that guarantees that the ticket is valid and maintains the authenticity of the instant game ticket. The price of the ticket is provided, as well as instructions.

A predetermined set of unique numerical play symbols representing dollar amounts is provided, as is a game play grid on each ticket comprising a predetermined amount of horizontal rows. Each row is populated with a predetermined amount of play symbols wherein the play symbols in the left-hand position of each row are differing play symbols. The left-hand position of each row is designated as the first position. In this exemplary third embodiment of the present invention, four horizontal rows are provided and each row comprises four play symbols. The play symbol in the first position of the first row is a "5", followed by two adjoining play symbols "0" and "0". A multiplier (for instance "×2") symbol is in the last (right-hand) position. The play symbol in the first position of the second row is a "10", followed by two adjoining play symbols "0" and "0". A multiplier (for instance "×2") symbol is in the last (right-hand) position. The play symbol in the first position of the third row is a "20", followed by two adjoining play symbols "0" and "0". A multiplier (for instance "×2") symbol is in the last (right-hand) position. The play symbol in the first position of the fourth row is a "75", followed by three adjoining play symbols "0", "0" and "0". Each symbol in the game play grid is divided into three symbol sections. All of the symbols in the game play grid are covered with a transparent removable film. Each symbol section is marked with a unique marking symbol from a predetermined set of unique marking symbols. It is preferred that the marking symbols are numerals, and that the amount of numerals in the set of numerals equals the total amount of symbol sections. An array of unique numerals from the set of unique numerals is provided as player numbers, and is concealed by an opaque removable film.

The opaque removable film is scratched off to reveal the player numbers. Each numbered symbol section that matches a player number is removed to reveal the symbol section. If all symbol sections of a numerical symbol in the first position of any row are fully revealed, that is a winning symbol, and a dollar amount matching that numeral is awarded. For instance, if the "20" symbol is fully revealed, the player would win $20. If any symbols are fully revealed and are adjoining a winning symbol, a larger prize is awarded. For instance, if the "10" symbol is fully revealed, and the adjoining "0" symbol is fully revealed, the player would win $100. If a multiplier symbol is fully revealed, any wins in that row are multiplied.

Each of the preferred embodiments of the present invention above may also be offered as an electronic ticket and game. The method of conducting the game on an electronic device provides the same gameplay, except any removable films are instead removable layers. The removable layers may be removed automatically by a processor, or by utilizing any suitable tool such as a touchscreen, keyboard or mouse.

Reference to the Figures will assist in further understanding of the practice of the present invention.

FIG. 1A illustrates the first preferred embodiment of the present invention, providing the elements of present invention that afford the specific gameplay thereof. A physical lottery instant game ticket 2 is provided, wherein the elements shown are printed on the base card of the ticket. A price point of the ticket ($5) 4 and a game ticket name 6 are shown. A copy blurb highlighting the jackpot amount 8 is provided. A game grid 10 comprises nine play symbols with associated prizes: a TOAST & HONEY symbol 12 with its associated prize of $5 14, a BEAR symbol 16 with its associated prize of $10 18, a BEEHIVE symbol 20 with its associated prize of $20 22, a BUZZ symbol 24 with its associated prize of $50 26, a ×2 MULTIPLIER SYMBOL symbol 28 with its associated multiplier of DOUBLE WINS 30, a HONEY JAR symbol 32 with its associated prize of $100 34, a FLOWERS & BEE symbol 36 with its associated prize of $500 38, a HONEYBEE symbol 40 with its associated prize of $1000 42 and a DOLLAR SIGN symbol 44 with its associated prize of the jackpot $75,000 46. Each play symbol is divided into three sections. An area for player numbers ("YOUR NUMBERS") 48 and "How to Play" gameplay instructions 50 are provided.

Figure 1B:
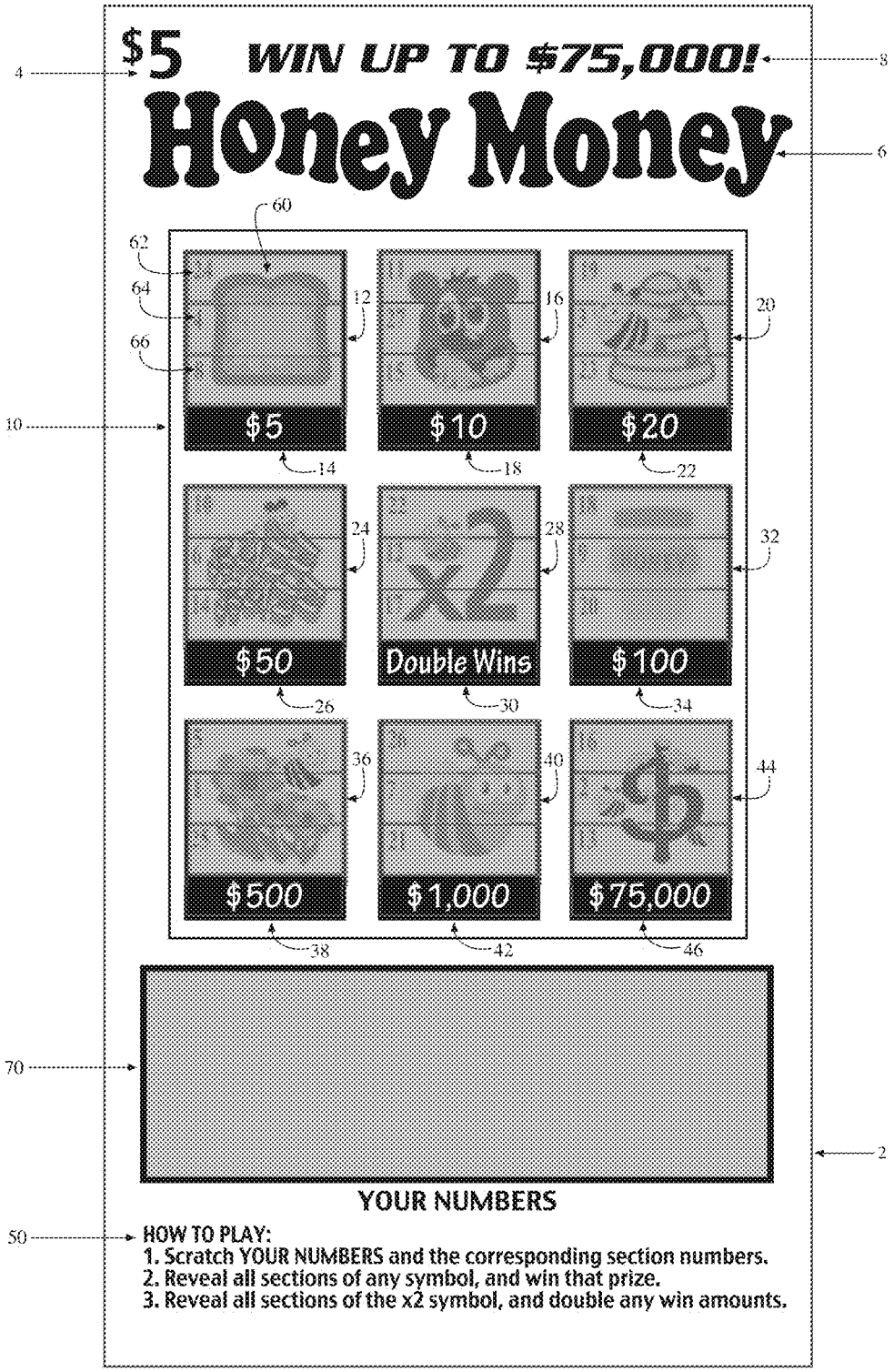
FIG. 1B refers to FIG. 1A and shows a final ticket.

FIG. 1B shows the elements of FIG. 1A wherein all of the play symbols in the game grid 10 are concealed by a transparent film 60. Each symbol section is labeled by a unique number from a set of numbers 1 through 27, as shown wherein (for example) the TOAST & HONEY symbol 12 is divided into symbol sections 62, 64, 66 that are numbered "24", "4" and "8" respectively. Fifteen player numbers (not shown) from the set of numbers 1 through 27 have been chosen and printed on the card under an opaque removable film 70.

Figure 1C:
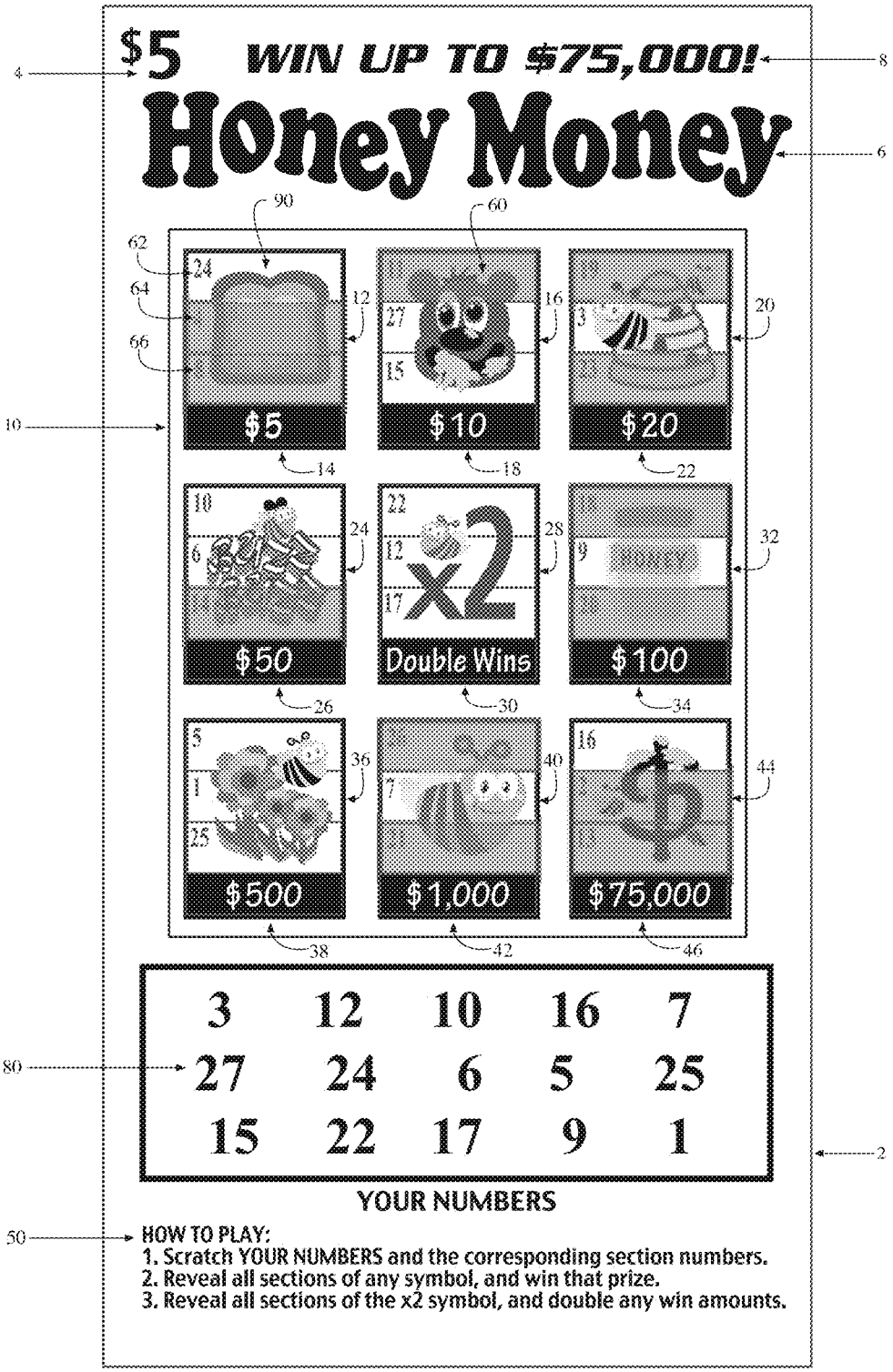
FIG. 1C refers to FIG. 1B and shows the final ticket after the final ticket has been scratched.

FIG. 1C shows the elements of FIG. 1B wherein the player, according to the gameplay instructions 50, has removed or "scratched off" the opaque film concealing the player numbers, revealing fifteen numbers (3, 12, 10, 16, 7, 27, 24, 6, 5, 25, 15, 22, 17, 9 and 1) 80. All numbered symbol sections that match a player number have been revealed by scratching off the transparent film. The FLOWERS & BEE symbol 36 has been fully revealed, so the player wins $500 38. However, the ×2 MULTIPLIER symbol 28 has also been fully revealed, so the final prize is $1000.

Figure 2A:
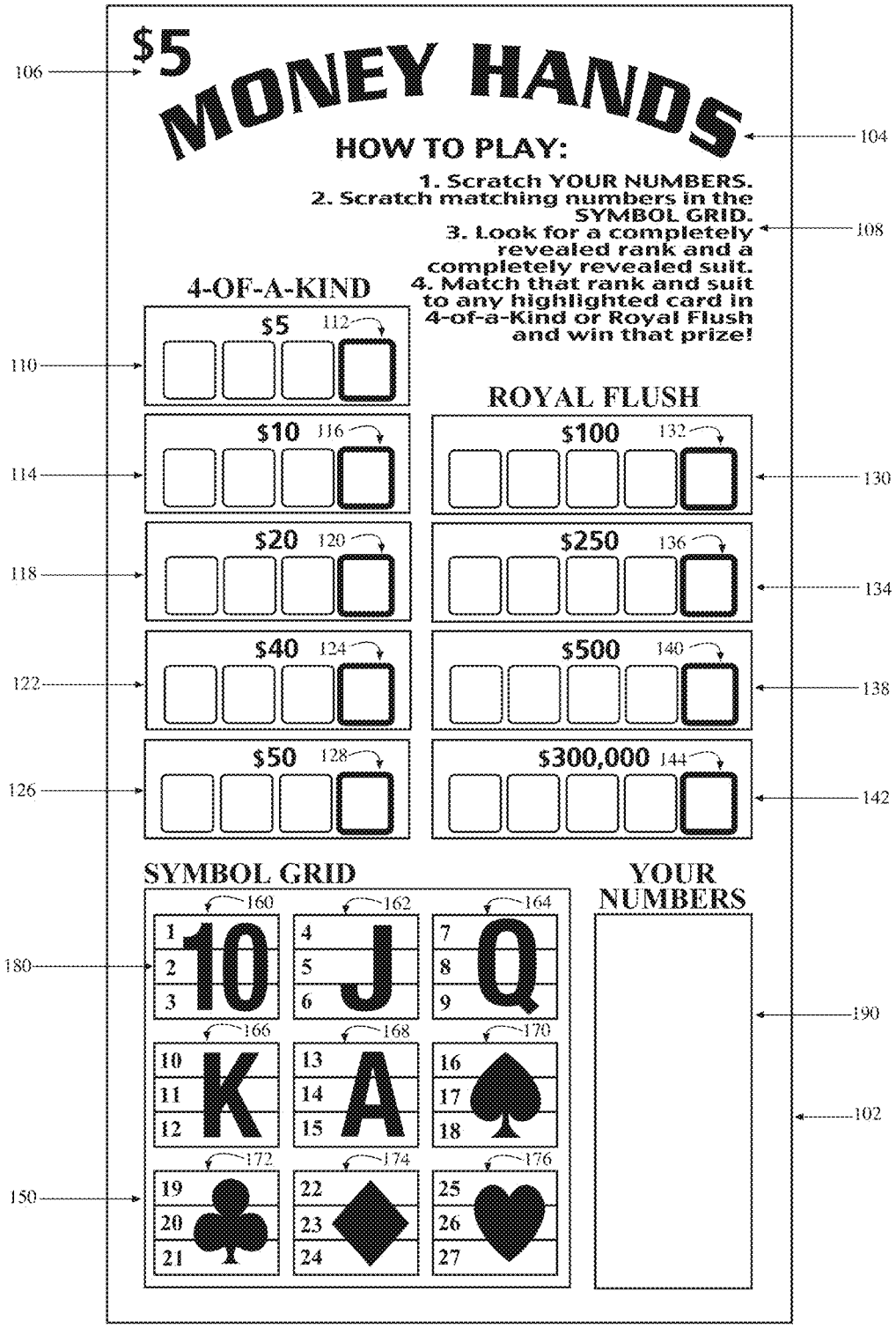
FIG. 2A shows the base card of an instant scratch ticket containing the game elements for a game utilizing the game technology described in a second preferred embodiment of the present invention herein.

FIG. 2A illustrates the second preferred embodiment of the present invention, providing the elements of present invention that afford the specific gameplay thereof. A physical lottery instant game ticket 102 is provided, comprising a game ticket name 104 and a price point of the ticket ($5) 106. "How to Play" gameplay instructions 108 are provided. Nine game play areas are provided: five for 4-of-a-Kind hands, and four for Royal Flush hands. Each game play area comprises a symbol area comprising symbol spaces (herein "playing cards") wherein one symbol space is a target win space (herein "target win playing card"). A prize is associated with each target win playing card. Specifically, game play area 110 comprises four playing cards in a row wherein the highlighted last card is the target win playing card 112 and the associated prize is $5. Game play area 114 comprises four playing cards in a row wherein the highlighted last card is the target win playing card 116 and the associated prize is $10. Game play area 118 comprises four playing cards in a row wherein the highlighted last card is the target win playing card 120 and the associated prize is $20. Game play area 122 comprises four playing cards in a row wherein the highlighted last card is the target win playing card 124 and the associated prize is $40. Game play area 126 comprises four playing cards in a row wherein the highlighted last card is the target win playing card 128 and the associated prize is $50. Game play area 130 comprises five playing cards in a row wherein the highlighted last card is the target win playing card 132 and the associated prize is $100. Game play area 134 comprises five playing cards in a row wherein the highlighted last card is the target win playing card 136 and the associated prize is $250. Game play area 138 comprises five playing cards in a row wherein the highlighted last card is the target win playing card 140 and the associated prize is $500. Game play area 142 comprises five playing cards in a row wherein the highlighted last card is the target win playing card 144 and the associated prize is the jackpot of $300,000. A symbol grid 150 is shown, comprising nine boxed areas 180 that each comprise one play symbol: a "10" symbol 160, a "Jack" symbol 162, a "Queen" symbol 164, a "King" symbol 166, an "Ace" symbol 168, a "Spade" symbol 170, a "Club" symbol 172, a "Diamond" symbol 174 and a "Heart" symbol 176. Each of the nine boxed areas are divided into three symbol sections, wherein each symbol section is marked with unique number from the set of numbers 1 through 27. A box for player numbers ("YOUR NUMBERS") 190 is provided.

Figure 2B:
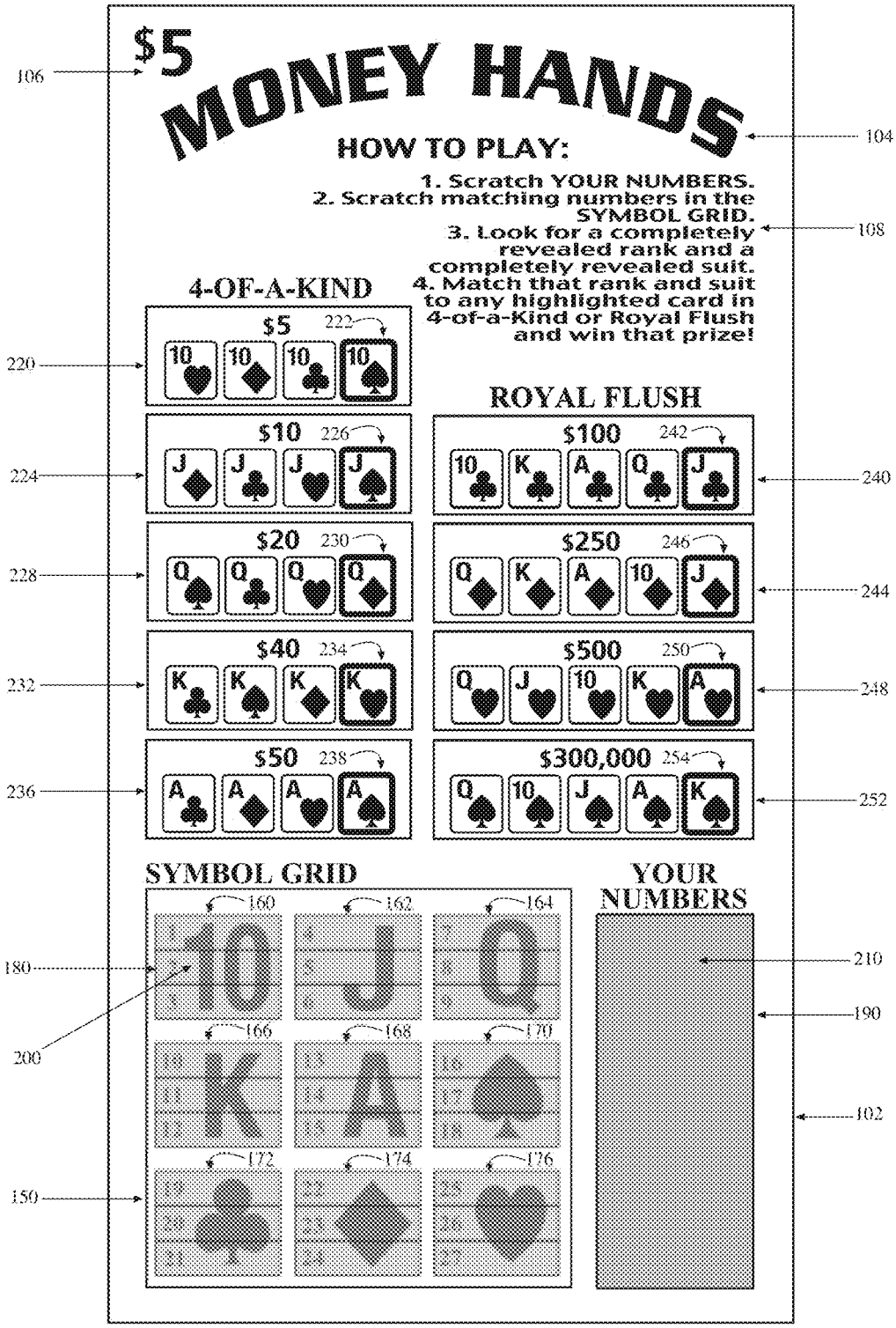
FIG. 2B refers to FIG. 2A and shows a final ticket.

FIG. 2B shows a final instant ticket with the elements of FIG. 2A wherein all of the play symbols in the symbol grid 180 are concealed by a transparent film 200. Sixteen player numbers (not shown) from the set of numbers 1 through 27 have been chosen and printed on the card under an opaque removable film 190. All of the game play areas are now filled in with playing cards: game play area 220 comprises four "10" cards wherein the target win playing card is the 10 of Spades 222, game play area 224 comprises four "Jack" cards wherein the target win playing card is the Jack of Spades 226, game play area 228 comprises four "Queen" cards wherein the target win playing card is the Queen of Diamonds 230, game play area 232 comprises four "King" cards wherein the target win playing card is the King of Hearts 234, game play area 236 comprises four "Ace" cards wherein the target win playing card is the Ace of Spades 238, game play area 240 comprises five "Club" cards wherein the target win playing card is the Jack of Clubs 242, game play area 244 comprises five "Diamond" cards wherein the target win playing card is the Jack of Diamonds 246, game play area 248 comprises five "Heart" cards wherein the target win playing card is the Ace of Hearts 250 and game play area 252 comprises five "Spade" cards wherein the target win playing card is the King of Spades 254.

Figure 2C:
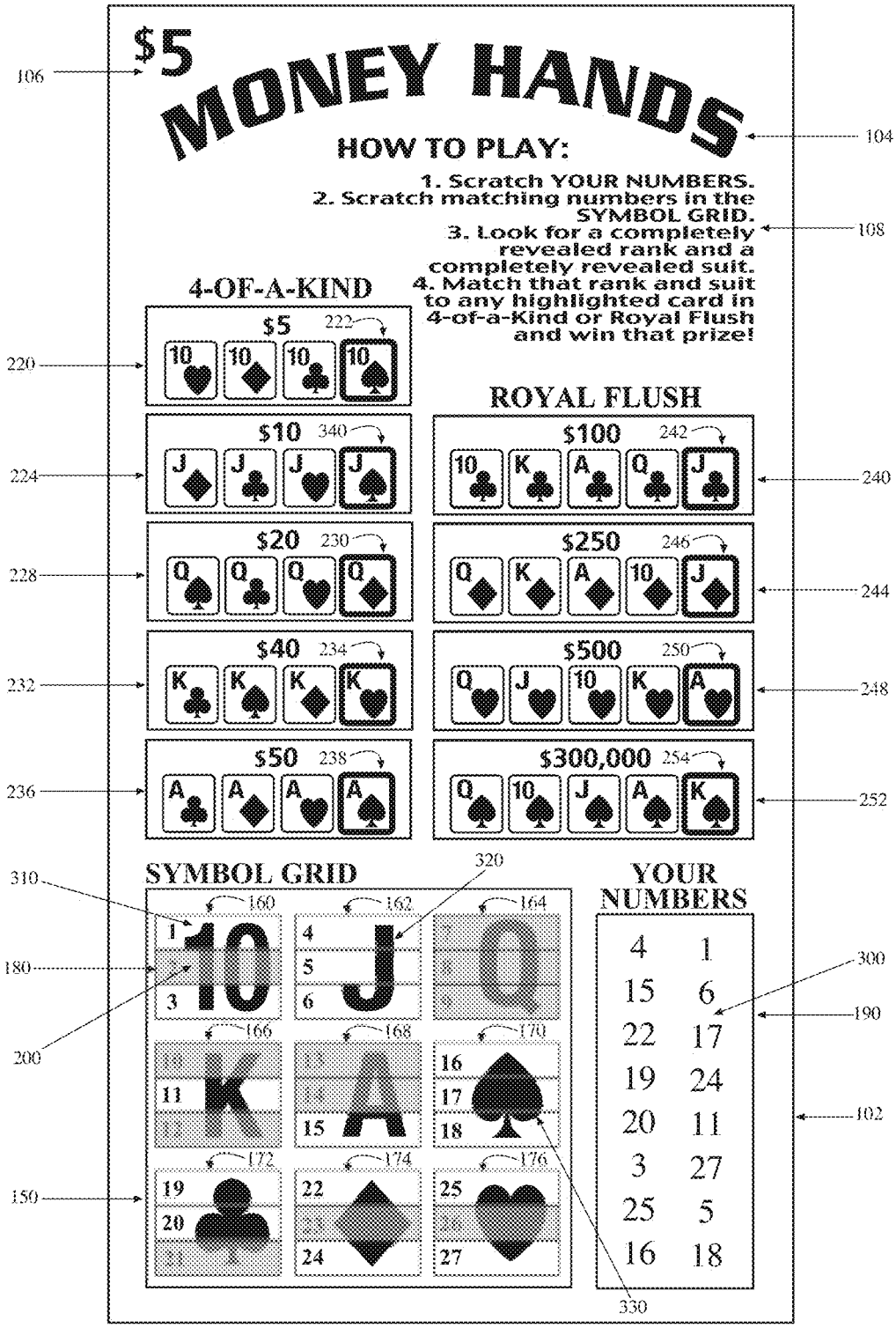
FIG. 2C refers to FIG. 2B and shows the final ticket after the final ticket has been scratched.

FIG. 2C shows the elements of FIG. 2B wherein the player, according to the gameplay instructions 108, has removed or "scratched off" the opaque film 190 concealing the player numbers, revealing sixteen numbers (4, 1, 15, 6, 22, 17, 19, 24, 20, 11, 3, 27, 25, 5, 16 and 18) 300. All numbered symbol sections that match a player number have been revealed by scratching off the transparent film. It is preferable that one rank and one suit will always be revealed on any one instant ticket. Here the "Jack" symbol 162 has been fully revealed 320, and the "Spade" symbol 170 has been fully revealed 330, providing the winning player card "Jack of Spades". The Jack of Spades 340 is the target win playing card in the 4-of-a-Kind "Jacks" hand, for a win $10. It should be noted that each play symbol will appear in at least one target win playing card, since the 4-of-a-Kind hands comprise each of the five ranks, and the Royal Flush hands comprise each of the four suits. This increases anticipation and excitement as the symbol sections are revealed, since no matter which symbol is first fully revealed, there is always the chance of a win.

Figure 3A:
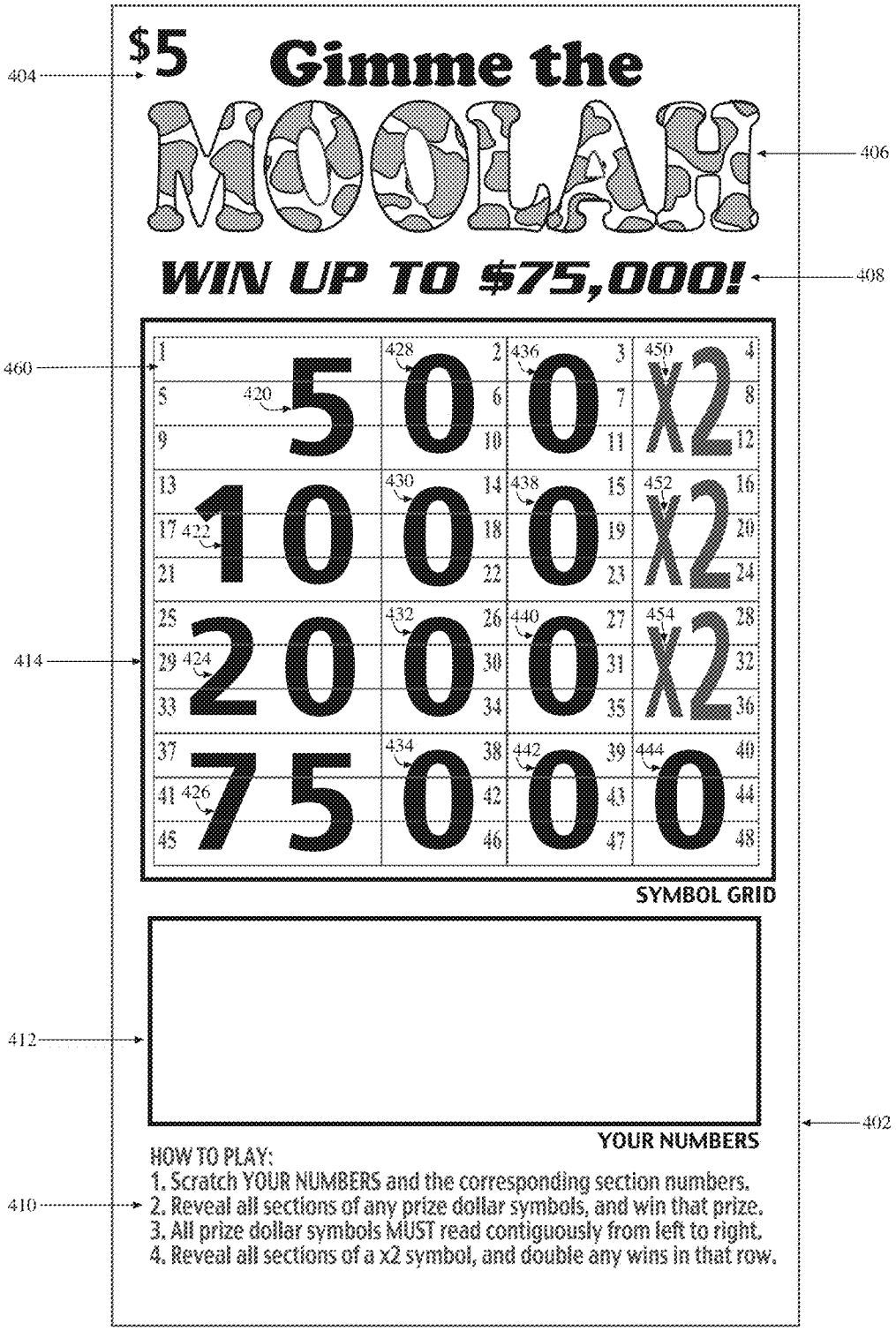
FIG. 3A shows the base card of an instant scratch ticket containing the game elements for a game utilizing the game technology described in a third preferred embodiment of the present invention herein.

FIG. 3A illustrates the third preferred embodiment of the present invention, providing the elements of present invention that afford the specific gameplay thereof. A physical lottery instant game ticket 402 is provided, wherein the elements shown are printed on the base card of the ticket. A price point of the ticket ($5) 404 and a game ticket name 406 are shown. A copy blurb highlighting the jackpot amount 408 is provided. "How to Play" gameplay instructions 410 and an area for player numbers ("YOUR NUMBERS") 412 are provided. A game play grid ("SYMBOL GRID") 414 provides thirteen play symbols (420, 422, 424, 426, 428, 430, 432, 434, 436, 438, 440, 442, 444) and three multiplier symbols (450, 452, 454). Each play symbol and multiplier symbol is divided into three sections and marked by a unique number from the set of numbers 1 through 48, as shown by the "Section 1" 460. The play symbols represent dollar prize amounts, and MUST read from left to right in four rows as follows: The play symbol "5" 420 is in the first position of the first row reading "5" "0" "0" "×2". The play symbol "10" 422 is in the first position of the second row reading "10" "0" "0" "×2". The play symbol "20" 424 is in the first position of the third row reading "20" "0" "0" "×2". The play symbol "75" 426 is in the first position of the fourth row reading "75" "0" "0" "0". Multiplier symbols pertain ONLY to any wins in the same row.

Figure 3B:
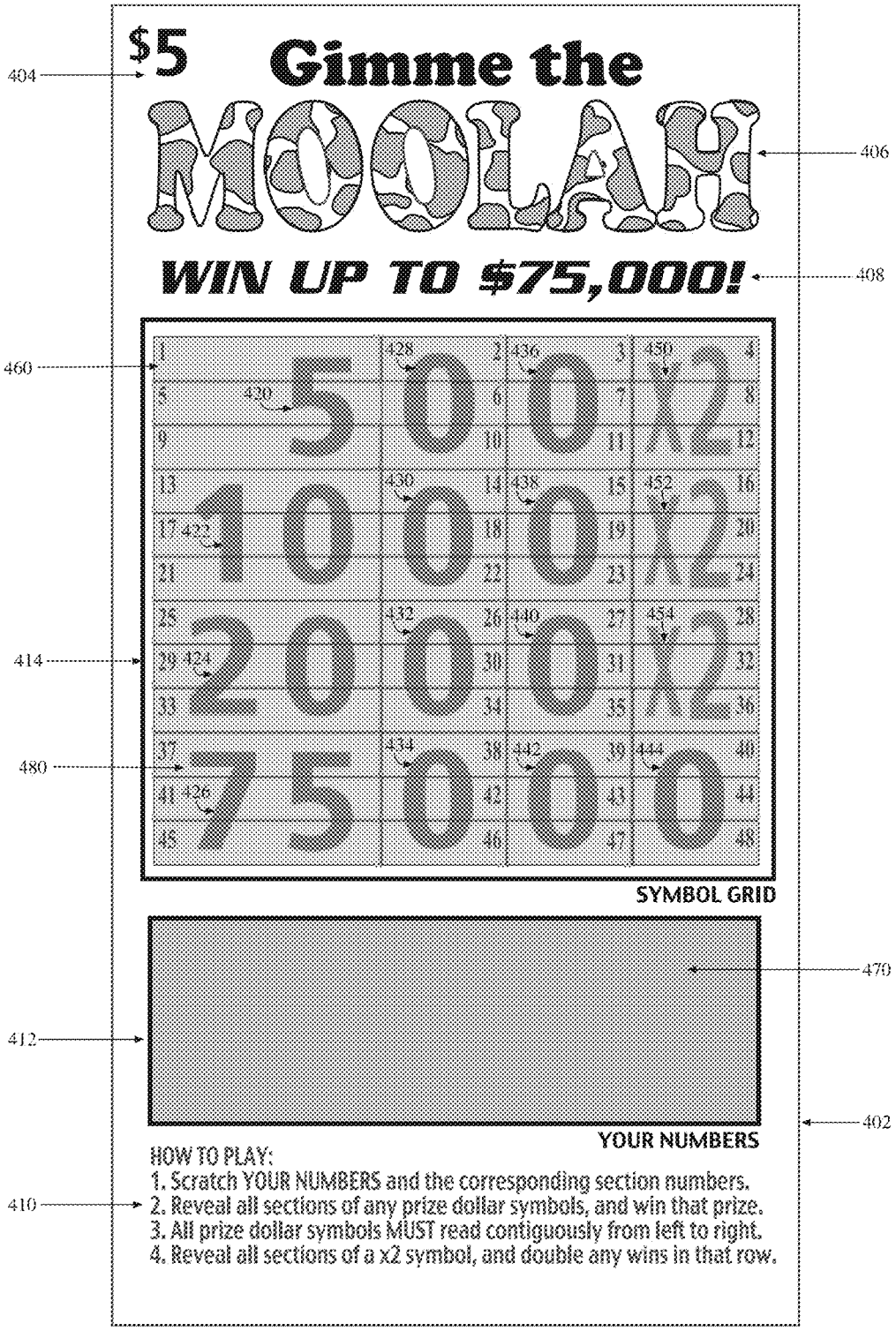
FIG. 3B refers to FIG. 3A and shows a final ticket.

FIG. 3B shows the elements of FIG. 3A wherein all of the play symbols in the symbol grid 414 are concealed by a transparent film 480. Twenty-one player numbers (not shown) from the set of numbers 1 through 48 have been chosen and printed on the card under an opaque removable film 470.

Figure 3C:
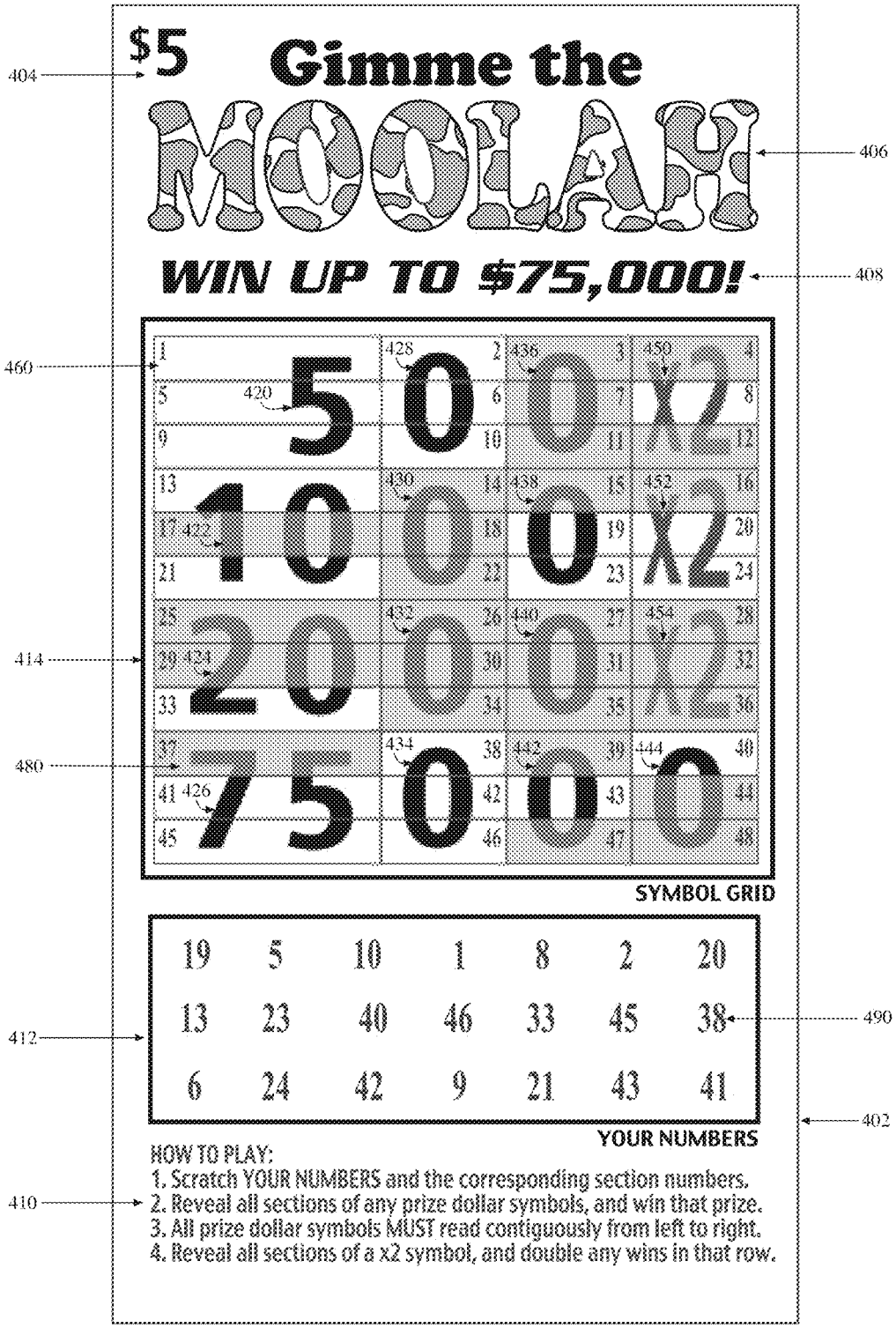
FIG. 3C refers to FIG. 3B and shows the final ticket after the final ticket has been scratched.

FIG. 3C shows the result of a first ticket with the elements of FIG. 3B wherein the player, according to the gameplay instructions 410, has removed or "scratched off" the opaque film concealing the player numbers, revealing twenty-one numbers 490. All numbered symbol sections that match a player number have been revealed by scratching off the transparent film. The "5" play symbol 420 has been fully revealed, as has the adjoining "0" play symbol, so the player wins $50. (Two or more fully revealed play symbols MUST be adjoining in order win amounts larger than a first position play symbol win.)

Figure 4:
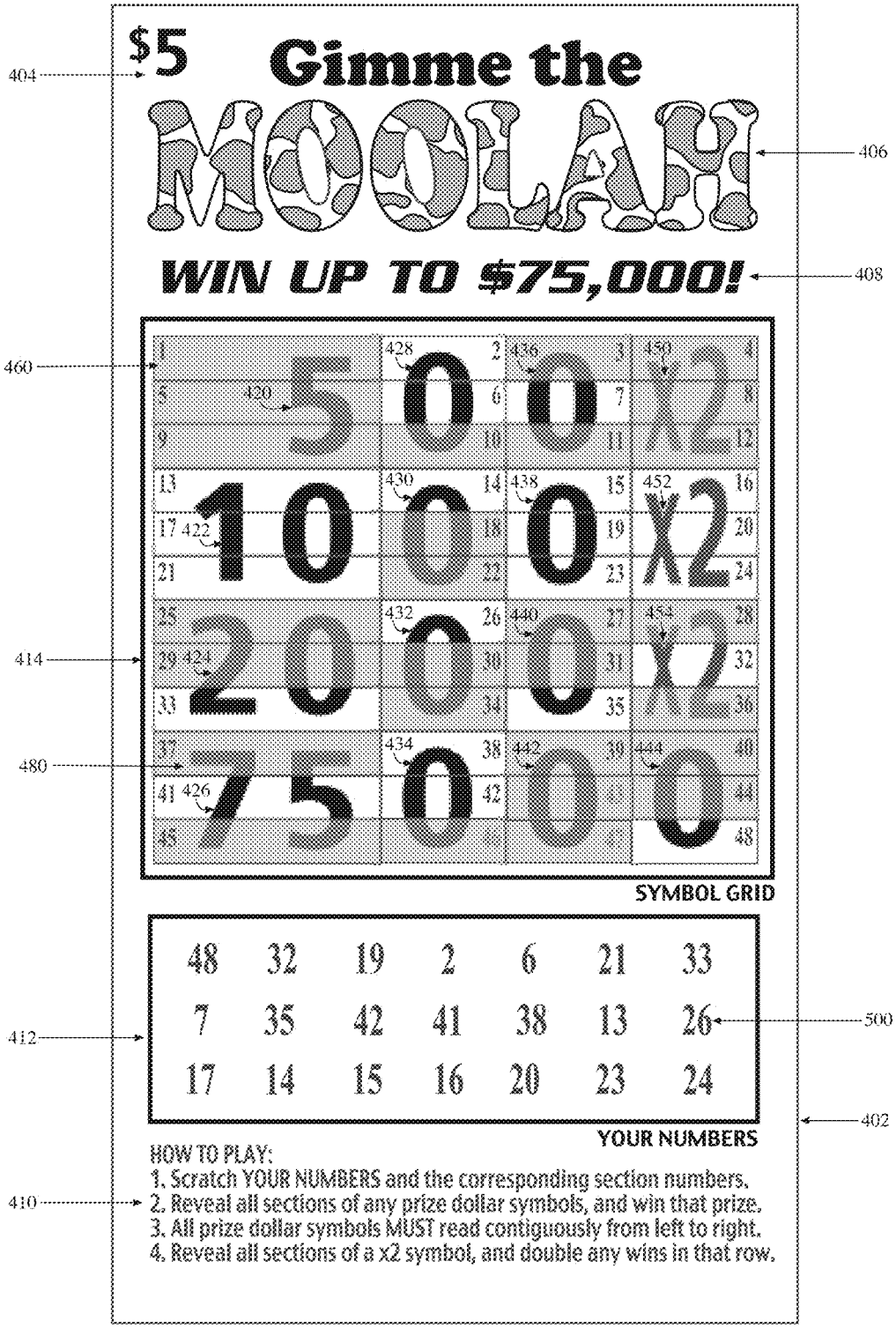
FIG. 4 refers to FIGS. 3A and 3B and shows a second final ticket after the second final ticket has been scratched.

FIG. 4 shows the result of a second ticket with the elements of FIG. 3B wherein the player, according to the gameplay instructions 410, has removed or "scratched off" the opaque film concealing the player numbers, revealing twenty-one numbers 500. All numbered symbol sections that match a player number have been revealed by scratching off the transparent film. The "10" play symbol 422 has been fully revealed, as has the "×2" multiplier symbol in the same row, so the player wins $20. It should be noted that although the "0" play symbol 438 has been fully revealed, it does not adjoin the "10" play symbol, so it does not change the $10 win to a $100 win.

Although specific examples and specific win amounts have been provided in this discussion, these specifics are intended to be only support for the generic concepts of the invention and are not intended to be absolute limits in the scope of the technology discussed.

What is claimed:

1. An instant scratch card ticket and method of conducting a lottery instant scratch ticket game that comprises:

a) providing a plurality of physical scratch tickets;

b) providing a predetermined set of unique play symbols;

c) providing a predetermined amount of play spaces;

d) populating each play space with a play symbol from the predetermined set of unique play symbols;

e) providing a different prize associated with each play symbol;

f) dividing each play symbol into at least two play symbol sections wherein each play symbol section is associated with exactly only one potential winning prize;

g) covering all of the play symbol sections with a removable film;

h) providing a predetermined set of unique marking symbols;

i) providing one unique marking symbol from the set of marking symbols for each play symbol section;

j) providing an array of marking symbols on each ticket from the set of marking symbols as player symbols;

k) concealing the player symbols with an opaque removable film;

l) revealing each player symbol by removing the opaque removable film concealing the player symbols;

m) removing the removable film comprising each marking symbol and its associated play symbol section that matches a player symbol to reveal the play symbol section;

n) determining if all of the play symbols sections of at least one play symbol are fully revealed; and o) providing the prize associated with each fully revealed play symbol.

2. The instant scratch card ticket and method of claim 1 wherein the removable film covering the play symbol sections is a transparent film.

3. The instant scratch card ticket and method of claim 1 wherein the removable film covering the play symbol sections is an opaque film.

4. The instant scratch card ticket and method of claim 1 wherein each play symbol is divided into like amounts of play symbol sections.

5. The instant scratch card ticket and method of claim 1 wherein at least two play symbols are divided into differing amounts of play symbol sections.

6. An instant scratch card ticket and method of conducting a lottery instant scratch ticket game that comprises:

a) providing a plurality of physical scratch tickets;

b) providing a first predetermined set of unique play symbols;

c) providing a second predetermined set of unique play symbols wherein all of the play symbols in the second set of play symbols differ from all of the symbols in the first set of play symbols;

d) providing a first game play area on each ticket comprising an array of symbol areas wherein the amount of symbol areas equals the amount of play symbols in the first set of play symbols and wherein each symbol area comprises an equal amount of symbol spaces;

e) providing a second game play area on each ticket comprising an array of symbol areas wherein the amount of symbol areas equals the amount of play symbols in the second set of play symbols and wherein each symbol area comprises an equal amount of symbol spaces;

f) designating one symbol space in each symbol area as a target win space;

g) providing different prizes for each target win space;

h) populating all of the symbol spaces with one play symbol from the first set of play symbols and one play symbol from the second set of play symbols wherein all symbol spaces within any specific symbol area comprise either one specific play symbol from the first set of play symbols or one specific play symbol from the second set of play symbols;

i) providing a boxed area on each ticket comprising one each of all of the play symbols in the first set of play symbols and one each of all of the play symbols in the first set of play symbols;

j) dividing each play symbol in the boxed area into at least two play symbol sections;

k) covering all of the play symbol sections in the boxed area with a removable film;

l) providing a predetermined set of unique marking symbols;

m) providing one unique marking symbol from the set of marking symbols for each symbol section;

n) providing an array of marking symbols on each ticket from the set of marking symbols as player symbols;

o) concealing the player symbols with an opaque removable film;

p) revealing each player symbol by removing the opaque removable film concealing the player symbols;

q) removing the removable film comprising each marking symbol and its associated symbol section that matches a player symbol to reveal a symbol section;

r) determining if all of the symbols sections of at least one play symbol from the first set of play symbols and at least one play symbol from the second set of play symbols are fully revealed;

s) determining if the fully revealed play symbols match both of the play symbols in any target win space; and t) providing any prizes associated with said target win space.

7. The instant scratch card ticket and method of claim 6 wherein the first set of play symbols comprises five playing card rank symbols (10, J [Jack], Q [Queen], K [King] and A [Ace] symbols, and the second set of play symbols comprises four playing card suit symbols (Clubs, Diamonds, Hearts and Spades).

8. The instant scratch card ticket and method of claim 6 wherein the first game area comprises five symbol areas, each symbol area comprising four symbol spaces.

9. The instant scratch card ticket and method of claim 8 wherein the symbol areas comprise 4-of-a Kind hands of playing cards, each symbol space comprising a playing card.

10. The instant scratch card ticket and method of claim 6 wherein the second game area comprises four symbol areas, each symbol area comprising five symbol spaces.

11. The instant scratch card ticket and method of claim 10 wherein the symbol areas comprise Royal Flush hands of playing cards, each symbol space comprising a playing card.

12. The instant scratch card ticket and method of claim 6 wherein the set of marking symbols comprises numbers or letters.

13. The instant scratch card ticket and method of claim 6 wherein the play symbols in the boxed area are each divided into three play symbol sections.

14. The instant scratch card ticket and method of claim 6 wherein the removable film covering the play symbol sections is a transparent film.

15. The instant scratch card ticket and method of claim 6 wherein the removable film covering the play symbol sections is an opaque film.

16. An instant scratch card ticket and method of conducting a lottery instant scratch ticket game that comprises:

a) providing a plurality of physical scratch tickets;

b) providing a predetermined set of numerical play symbols representing dollar amounts;

c) providing a predetermined amount of horizontal rows;

d) populating each row with a predetermined amount of said play symbols wherein the play symbols in the left-hand position of each row are differing said play symbols;

e) designating the left-hand position of each row as the first position;

f) dividing each play symbol into at least two play symbol sections;

g) covering all of the play symbols with a removable film;

h) providing a predetermined set of unique marking symbols;

i) providing one unique marking symbol from the set of marking symbols for each play symbol section;

j) providing an array of marking symbols on each ticket from the set of marking symbols as player symbols;

k) concealing the player symbols with an opaque removable film;

l) revealing each player symbol by removing the opaque removable film concealing the player symbols;

m) removing the removable film comprising each marking symbol and its associated play symbol section that matches a player symbol to reveal the play symbol section;

n) determining if all of the play symbols sections of at least one play symbol in the first position of a row are fully revealed;

o) determining if any additional play symbols are fully revealed and contiguous with any fully revealed first position play symbols, wherein said fully revealed and contiguous play symbols associated with a fully revealed first position play symbol provide a single numerical symbol having digits reading from left to right that provides a dollar amount prize; and p) providing any dollar amount wins associated with the fully revealed play symbols.

17. The instant scratch card ticket and method of claim 16 wherein the removable film covering the play symbol sections is a transparent film.

18. The instant scratch card ticket and method of claim 16 wherein the removable film covering the play symbol sections is an opaque film.

19. The instant scratch card ticket and method of claim 16 wherein the play symbols are divided into three play symbol sections.

20. The instant scratch card ticket and method of claim 16 wherein a multiplier symbol is provided for at least one row of play symbols.

21. The instant scratch card ticket and method of claim 20 wherein the multiplier symbol is divided into at least two multiplier symbol sections.

22. The instant scratch card ticket and method of claim 21 wherein one unique marking symbol from the set of marking symbols minus the marking symbols of the play symbols is provided for each section of the multiplier symbol sections.

23. The instant scratch card ticket and method of claim 22 wherein the unique marking symbols of the multiplier symbol sections may be added to the player symbols.

24. The instant scratch card ticket and method of claim 23 wherein if a multiplier symbol is fully revealed, the said multiplier is applied to any wins in the same row.

* * * * *